United States Patent [19]

von Böckh

[11] Patent Number: 4,589,258

[45] Date of Patent: May 20, 1986

[54] WET-STEAM TURBINE PLANT

[75] Inventor: Peter von Böckh, Riniken, Switzerland

[73] Assignee: BBC Brown, Boveri & Company, Ltd., Baden, Switzerland

[21] Appl. No.: 552,028

[22] Filed: Nov. 15, 1983

[30] Foreign Application Priority Data

Nov. 24, 1982 [CH] Switzerland ..... 6845/82

[51] Int. Cl.[4] ..... F01K 7/22

[52] U.S. Cl. ..... 60/679; 60/653; 60/680; 122/483

[58] Field of Search ..... 60/653, 679, 680; 122/483

[56] References Cited

U.S. PATENT DOCUMENTS

| | | | |
|---|---|---|---|
| 1,054,248 | 2/1913 | Steinmuller | 122/483 |
| 1,954,823 | 4/1934 | Lucke | 60/680 |
| 3,306,353 | 2/1967 | Burne | 165/172 X |
| 3,930,371 | 1/1976 | Schabert | 60/679 X |

FOREIGN PATENT DOCUMENTS

| | | | |
|---|---|---|---|
| 47903 | 3/1979 | Japan | 60/680 |

*Primary Examiner*—Allen M. Ostrager

*Attorney, Agent, or Firm*—Oblon, Fisher, Spivak, McClelland & Maier

[57] ABSTRACT

In a wet-steam turbine plant, which comprises a high-pressure turbine (1), at least one low-pressure turbine (3), and a generator (4), and in which a high-velocity water separator (6) is provided in the connecting line (2) between the high-pressure turbine (1) and the low-pressure turbine (3), a reheater (7), of space-saving design, is located downstream of the water separator (6), between the lower and upper cross-connecting lines (2). The reheater (7) is connected in a manner such that the heating steam is admitted to it in cross-flow, and possesses a flow cross-section which approximates to that of the connecting line (2), so that it is a portion thereof.

5 Claims, 3 Drawing Figures

WET-STEAM TURBINE PLANT

Figure 1:
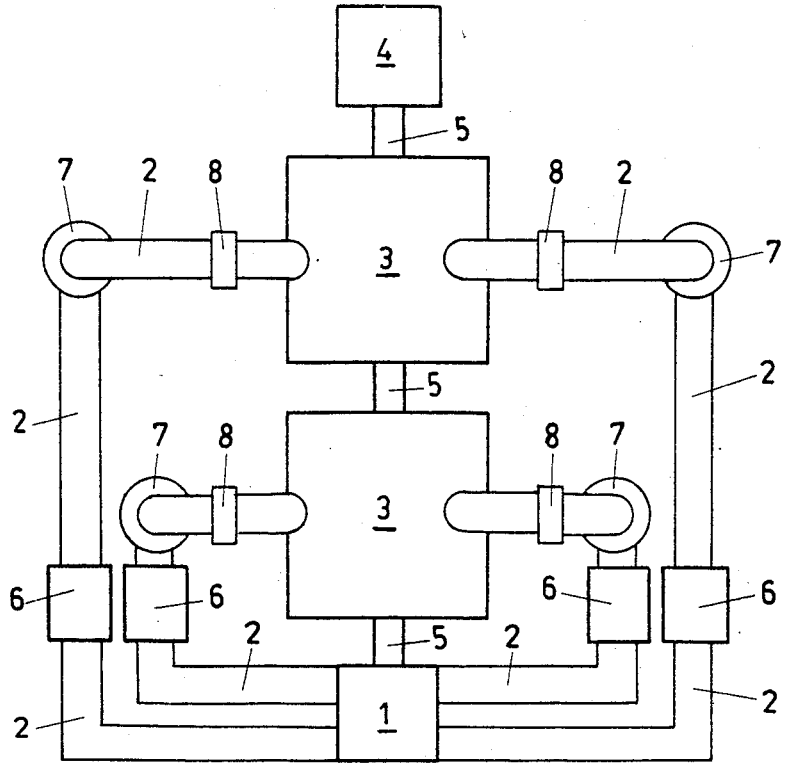

The present invention relates to a wet-steam turbine plant.

In order to improve the efficiency of the low-pressure turbine in wet-steam turbine plants, and in order to avoid erosion-corrosion, the steam emerging from the high-pressure turbine is dried, and then superheated. It is then possible to allow the steam to expand, in the low-pressure turbine, to a temperature at which it finally becomes saturated. The drying and superheating of the steam is conventionally effected in combined water-separators/reheaters. The reheaters are designed as tube-bundle heat-exchangers, the steam which is to be superheated flowing around the tubes and being heated by the steam which is condensing inside them. In the case of single-stage superheating, main steam is used as heating steam, while bleed steam and main steam are used in the case of multi-stage superheating.

Reheaters of the horizontal type usually operate with 1–2% of purging steam, in relation to the total heating-steam consumption. The safety devices which are required in order to avoid operating conditions which could lead, for example as a result of flow-surges and/or flow-backups, to the destruction of the tube bundles, are both bulky and expensive. Although reheaters of the vertical type admittedly require less purging steam, they nevertheless require considerably more space.

Reheaters are employed in order to optimise the overall efficiency. Due to their presence, the thermodynamic efficiency is considerably better than in the case of plants without reheaters.

It has also become known to carry out two-stage water-separation, using high-velocity separators, without superheating (B. Andrieux: "Evolution des condenseurs, des postes d'eau et des separateurs de vapeur [Development of condensers, bib-cocks, and steam separators]", AINI Liège, Centrales électriques modernes [Modern power stations]-1981). As explained in the Andrieux article and as used throughout this document, the term "high-velocity separator" means a separator having a flow speed of 40–70 meters/second—as opposed to conventional water separators, which have flow speeds in the range of 1–5 meters/second.

If water-separation is carried out in two stages, without superheating, the problems which are known to affect the reheater do not, admittedly, occur, but the efficiency of the turbine group is reduced. Moreover, an additional medium-pressure turbine is required, as well as a material, for both the medium-pressure and low-pressure turbines, which is resistant to erosion-corrosion.

The object of the present invention is to be seen as the provision of a wet-steam turbine plant in which it is possible to achieve a better efficiency than that which can be obtained with two-stage water-separation without reheaters, and in which wet-steam turbine plant the reheaters can be located in any desired installation position, without special expense.

The advantage of the arrangement according to the invention is evident, in particular, in the shorter line-routeing between the high-pressure and low-pressure sections, as well as in the space-saving design of the reheater-bundles, this design, and their installation downstream of the high-velocity water separator, enabling them to be installed in any desired position, that is to say to suit the particular space conditions, and resulting in the flow cross-section of the reheater being approximately equal to that of the connecting line. Furthermore, this arrangement reduces the total pressure-loss, and the working steam is no longer subject to acceleration and deceleration phases. Approximately 10% of the main steam is required in the case of conventional superheating, but only approximately 5% is required when the reheater is arranged in accordance with the invention.

Figure 2:
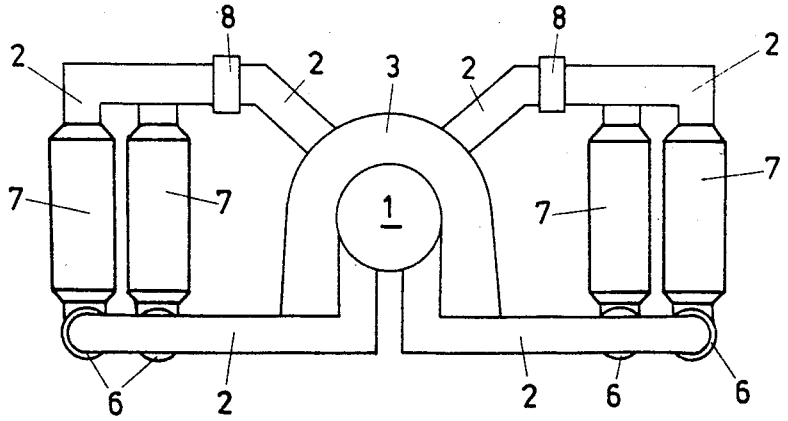
Figure 3:
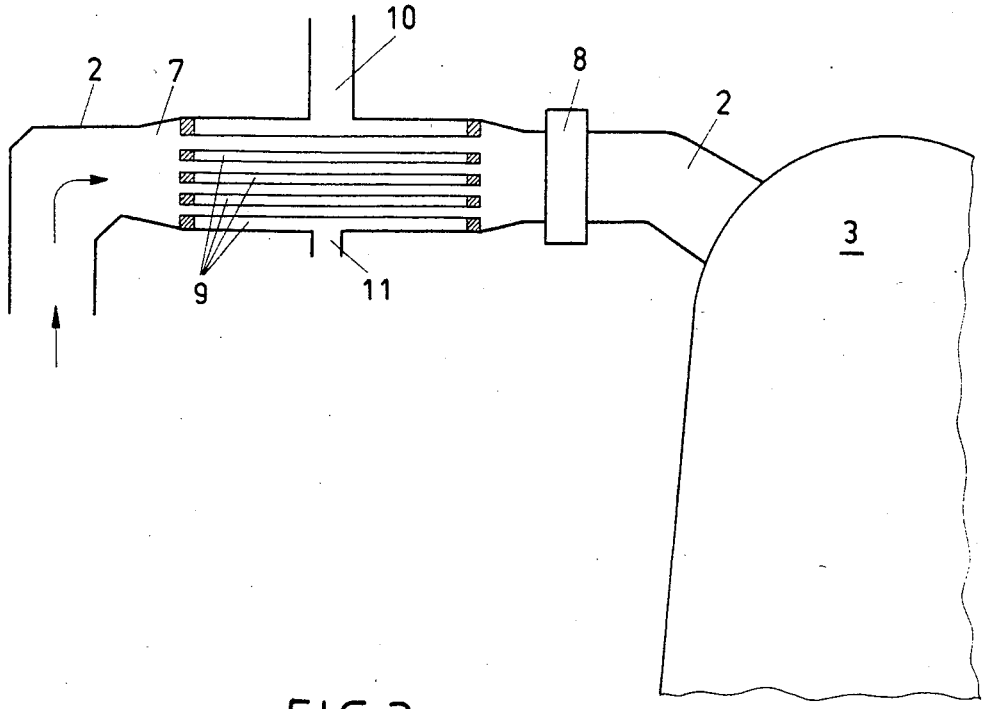

An illustrative embodiment of the subject of the invention is represented, in a simplified form, in the drawing, in which:

FIGS. 1 and 2 show an illustrative arrangement of a wet-steam turbine plant according to the invention, FIG. 3 shows, in detail, the arrangement of a reheater in a connecting line.

As shown in FIGS. 1 and 2, a high-pressure turbine is marked 1, its exhaust steam being supplied, via connecting lines 2, to low-pressure turbines 3. In the present case, two low-pressure turbines 3 are provided, the high-pressure turbine 1, the two low-pressure turbines 3, and a generator 4 being connected by a common shaft 5. A high-velocity water separator 6 and a reheater-bundle 7 are located, in each case downstream of the high-pressure turbine 1, in the lower and upper cross-connecting lines 2, this reheater-bundle 7 being of space-saving design and possessing a flow cross-section which deviates only insignificantly from that of the connecting lines. An intercept valve 8 is provided between each reheater-bundle 7 and the respective low-pressure turbine 3, although it is possible, without inviting problems, to omit these intercept valves 8, without the low-pressure turbines 3 being damaged by over-speeding.

FIG. 3 shows a possible arrangement of the reheater-bundle 7, with an intercept valve 8, in the connecting line 2 between the low-pressure turbine 3 and the inlet of the working steam coming from the high-velocity water separator 6 (not represented in FIG. 3). The working steam flows, in the direction indicated by the arrow, through the superheater-tubes 9 which are arranged inside the reheater 7, in cross-flow. Heating steam enters the reheater 7 through a nozzle 10, flows around the superheater-tubes 9, heats the working steam which is flowing through the superheater-tubes 9, and condenses on the superheater-tubes 9. The condensate flows away via an outlet nozzle 11.

In order to compensate the differential expansions which arise, it is also possible to design the reheater in, for example, an "L" or "U" shape, or to give it a spiral configuration. By this means, it is possible to adapt the reheaters, in a simple manner, to the prevailing local conditions.

The locations, according to the invention, of the reheaters 7 in the connecting lines 2 permits multi-stage superheating without requiring additional space, and any desired installation position is possible because the reheaters 7 form portions of the connecting lines 2.

I claim:

1. A saturated steam turbine installation comprising a high-pressure turbine (1), at least one low-pressure turbine (3), and a generator (4), in which a water separator (6) and a downstream reheater (7) are placed in a connection pipe (2) between said high-pressure turbine (1) and said at least one low-pressure turbine (3), characterized in that said water separator (6) placed in said connecting pipe (2) between said high-pressure turbine (1) and said at least one low-pressure turbine (3) is a high-velocity water separator having flow speeds of 40–70 meters/second and in that said downstream reheater (7) exhibits approximately the same flow cross section as said connecting pipe (2).

2. A saturated steam turbine installation as recited in claim 1 wherein said connecting pipe (2) is sized so that 5% of the total amount of steam is fed into said downstream reheater (7) for superheating of the steam flowing through said downstream reheater (7).

3. A wet-steam turbine plant comprising:

(a) a high-pressure turbine;

(b) at least one low-pressure turbine;

(c) a connecting line through which exhaust steam from said high-pressure turbine is supplied to said at least one low-pressure turbine;

(d) a generator driven by said high-pressure turbine and said at least one low-pressure turbine;

(e) a high-velocity water separator disposed in said connecting line;

(f) a reheater comprising a plurality of superheater tubes disposed in said connecting line between said high-velocity water separator and said at least one low-pressure turbine, said reheater having at least approximately the same cross-sectional area as said connecting line on either side of said reheater, said reheater having an inlet and an outlet;

(g) means for supplying hot steam to the inlet of said reheater, thereby reheating the exhaust steam in said connecting line; and (h) means for withdrawing cool steam from the outlet of said reheater.

4. A wet-steam turbine plant as recited in claim 3 wherein said reheater is a portion of said connecting line.

5. A saturated steam turbine installation comprising a high-pressure turbine (1), at least one low-pressure turbine (3), and a generator (4), in which a water separator (6) and a reheater (7) are placed in a connecting pipe (2) between said high-pressure turbine (1) and said at least one low-pressure turbine (3), characterized in that said water separator (6) is a high-velocity water separator (6) and in that said reheater (7) exhibits nearly the same flow cross section as said connecting pipe (2).

* * * * *